US006612313B1

(12) United States Patent
Fontaine

(10) Patent No.: US 6,612,313 B1
(45) Date of Patent: Sep. 2, 2003

(54) PART WHOSE REAR FACE IS COVERED BY A COATING ENABLING AN EFFECT OF THE LIGHT TO BE CREATED WHEN ITS FRONT FACE IS OBSERVED

(75) Inventor: Michel Fontaine, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/615,405

(22) Filed: Jul. 13, 2000

(30) Foreign Application Priority Data

Jul. 23, 1999 (FR) ..... 99 09590

(51) Int. Cl.[7] ..... A45D 42/02
(52) U.S. Cl. ..... 132/301
(58) Field of Search ..... 40/427, 546; 359/894, 359/614; 385/146; 215/12.1, 12.2, DIG. 2, DIG. 4; 434/303; 472/63; 132/293, 301, 304, 305, 316

(56) References Cited

U.S. PATENT DOCUMENTS

| | | | | | |
|---|---|---|---|---|---|
| 1,465,564 | A | * | 8/1923 | Saalburg | 40/427 |
| 1,975,703 | A | * | 10/1934 | Vitale | 220/602 |
| 2,421,646 | A | | 6/1947 | Pepin | |
| 2,649,387 | A | * | 8/1953 | Parsons et al. | 427/167 |
| 2,675,740 | A | * | 4/1954 | Barkley | 428/161 |
| 2,727,327 | A | * | 12/1955 | Colby | 40/546 |
| 4,285,889 | A | * | 8/1981 | Parsons | 264/2.6 |
| 5,003,715 | A | * | 4/1991 | Steiner | 40/442 |
| 5,773,110 | A | * | 6/1998 | Shields | 428/40.1 |
| 5,897,322 | A | * | 4/1999 | Shteyngarts | 434/84 |
| 6,053,322 | A | * | 4/2000 | Kim et al. | 206/575 |
| 6,093,455 | A | * | 7/2000 | Kamen et al. | 427/511 |
| 6,168,438 | B1 | * | 1/2001 | Leonard et al. | 434/81 |

FOREIGN PATENT DOCUMENTS

| | | | | |
|---|---|---|---|---|
| DE | EP 0 171 776 | A | 2/1986 | |
| FR | EP 0 044 781 | A | 1/1982 | |
| FR | EP 0 544 557 | A | 6/1993 | |
| FR | 2807630 | A1 * | 4/2001 | 132/301 |

OTHER PUBLICATIONS

"Exceptional Surfaces", American Artist; New York; Nov. 1999; Christopher Willard, vol. 63, issue 688, pp. 14–18.*

* cited by examiner

*Primary Examiner*—Eduardo C. Robert
(74) *Attorney, Agent, or Firm*—Oliff & Berridge, PLC

(57) ABSTRACT

The invention relates to a closure member for a makeup accessory receptacle, in particular for a skin-care product. The member has a top wall with a side skirt that extends around the periphery of the top wall downwards, and defines a front face of circular outline. The side skirt co-operates with the top wall to define a side face and a rear face. The top wall and the side skirt may be made as a single piece by molding a translucent plastic material and covering the front face and the side face in a layer of mat varnish. The rear face may be covered in a layer of dark-colored opaque paint, without discontinuity, over at least substantially the entire extend of the edge of the side skirt, over the inside surface of the side skirt, and over at least a portion of the inside surface of the top wall adjacent to the side skirt.

39 Claims, 1 Drawing Sheet

PART WHOSE REAR FACE IS COVERED BY A COATING ENABLING AN EFFECT OF THE LIGHT TO BE CREATED WHEN ITS FRONT FACE IS OBSERVED

The present invention relates to a part made of plastics material or of glass, and more particularly but not exclusively a closure member for a makeup accessory or receptacle.

BACKGROUND OF THE INVENTION

In the field of packaging cosmetics, it is known to make covers or caps out of transparent plastics materials that are colored in bulk or opaque, and possibly filled.

OBJECTS AND SUMMARY OF THE INVENTION

The invention seeks to obtain a novel appearance effect for a part having a front face, a rear face, and an outer face.

The invention achieves this by the part being made of a material that is not opaque, and by the rear face being made opaque at least in locations close to said outer face by means of a layer of an opaque coating of dark color in intimate contact with said non-opaque material, the location of the coating and its color being selected in such a manner as to enable light that enters via the outer face to create an effect of the light within the part and visible from its front face.

By means of the invention, it is possible in particular to obtain a halo effect on a part whose front face has a circular outline, which effect can be particularly attractive.

The shape of the part is selected in such a manner as to cause the halo effect to be visible over a peripheral zone of the front face that is no greater than the height of the outer face.

In a particular embodiment, the coating is present at locations selected on the part in such a manner that only light entering via the outer face or the edge of the rear face can pass through the part.

In a particular embodiment, it is a paint.

In a variant, it is a layer deposited by bi-injection of a material that is physically and chemically compatible with said non-opaque material.

This guarantees intimate contact between the coating and the non-opaque material and also the absence of air, which would interfere with obtaining the desired result.

The color of the coating is selected as a function of the color of the non-opaque material so as to obtain sufficient contrast to enable the desired optical effect to be observed.

The coating is for example black, thereby making it possible to avoid interfering reflections in the part and to obtain the required opaqueness while using only a thin layer of coating.

Preferably, the plastics material used is translucent.

Thus, light which penetrates into the part via its outer face is diffused as it passes through the part, thus favoring the obtention of an effect of the light in the part.

In a particular embodiment, the rear face is completely covered by said coating, e.g. paint is deposited by spraying.

Still in a particular embodiment, the part includes an inner housing opening out to its rear face.

When the part is a cover, such a housing can serve to receive a mirror.

The inner housing can be defined by a side surface and by a main surface, the side surface being preferably entirely covered without discontinuity by the opaque coating as is a margin of the bottom surface adjacent to said side surface.

This ensures that even when an opaque element such as a mirror is fitted against the main face, the clearance that exists between the mirror and the side surface of the inner housing does not allow any beam of light to pass which would spoil the appearance of the part.

The side surface of the inner housing can be cylindrical or substantially cylindrical, for example.

Preferably, the edge of the part which extends between the side surface of the inner housing and the outer face is covered without discontinuity over substantially its entire extent by the opaque coating used; this is even more preferable when the edge of the part is wide.

Still in a particular embodiment, the front face is outwardly slightly concave.

Advantageously, the front face and the outer face are covered in a layer of mat varnish that diffuses light and produces a soft feel effect.

The outer face can be at least particularly cylindrical or conical, or indeed substantially cylindrical and then conical, diverging forwards.

When the outer face flares forwards, the halo effect is reinforced by the thickness of the material decreasing on coming closer to the front edge.

The part can constitute all or a portion of a packaging device and when the part constitutes a closure member, it can include a hinge lug projecting from its rear face and integrally molded with the remainder of the part.

The invention also provides a closure member for a makeup accessory of receptacle, in particular for a skin-care product, the member having a top wall and a side skirt extending the periphery of said top wall downwards, said top wall defining a front face of circular outline, the side skirt co-operating with the margin of the top wall to define an outer face, the top wall and the side skirt defining a rear face, the top wall and the side skirt being made as a single piece by molding a translucent plastics material, the front face and the outer face being covered in a layer of mat varnish, the rear face being covered in a layer of dark-colored opaque paint without discontinuity over at least substantially the entire extend of the edge of the side skirt, over the inside surface of the side skirt, and over at least a portion of the inside surface of the top wall adjacent to the side skirt.

BRIEF DESCRIPTION OF THE DRAWING

The invention will be better understood on reading the following detailed description of a non-limiting embodiment, and on examining the accompanying drawing, in which.

MORE DETAILED DESCRIPTION

Figure 1:
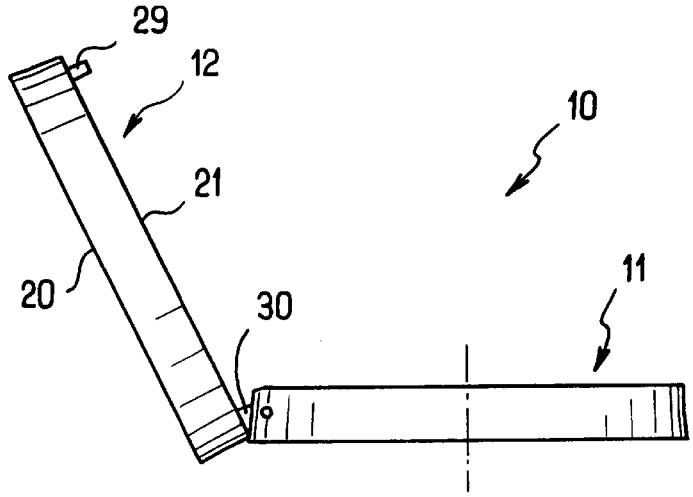
FIG. 1 is a diagrammatic view of a pack including a cover of the invention.

The pack 10 shown diagrammatically in FIG. 1 comprised a body 11 and a cover 12 hinged to the body 11.

The body 11 is intended to receive foundation makeup, for example.

Figure 2:
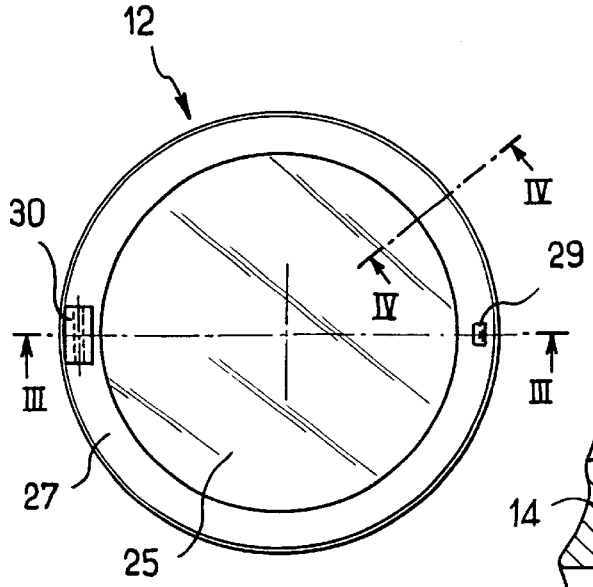
FIG. 2 is a view of the underside of the cover.
Figure 3:
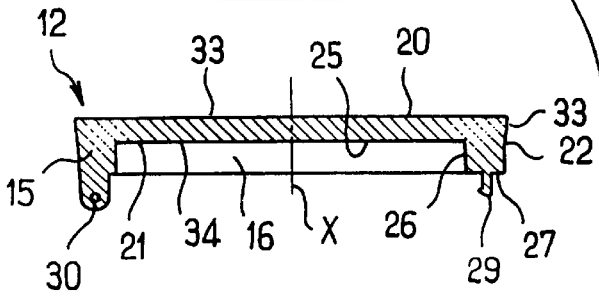
FIG. 3 is an axial section on section line III—III of FIG. 2.

The cover 12 which is shown on its own in FIGS. 2 and 3 is made in the present example out of a plastics material that is colorless, translucent, and not filled, for example ABS.

Naturally, the invention is not limited to using this particular material, and for example it is possible to use: PET, polycarbonate, PCTG, or PMMA, this list not being exhaustive.

The cover 12 has a top wall 14 extended downwards at its periphery by a side skirt 15 integrally molded out of the same plastics material as the wall 14.

Figure 4:
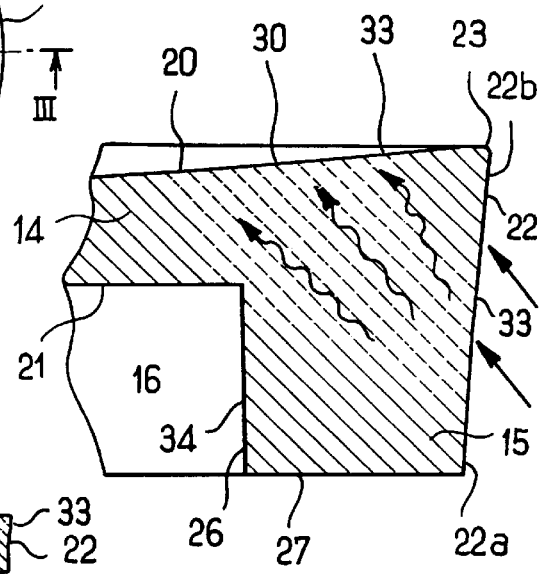
FIG. 4 is a section on section line IV—IV of FIG. 2 showing how light propagates after entering the part through its outer face.

The top face of the top wall 14 is slightly concave outwards as can be seen in FIG. 4, and it defines the front face of the cover 12.

The side skirt 15 forms an inner housing 16 defined by a side surface 26 which is circularly cylindrical about an axis X, and by a main surface 25 that is plane and perpendicular to the axis X, corresponding to the bottom face of the wall 14.

The rear face 21 of the cover 12 is formed by the main surface 25, the side surface 26, and the edge 27 of the cover 12 in combination.

In the example described, the housing 16 is to receive a mirror.

The outer face 22 of the cover 12 interconnects the front and rear faces 20 and 21.

The front face 20 has a circular edge 23 and the outer face 22 is substantially circularly cylindrical about the axis X in its rear region 22*a*, after which it is conical, diverging towards the edge 23 of the front face 20 in the front region 22*b* of the cover.

The edge 27 of the cover 12 extends perpendicularly to the axis X between the side surface 26 and the outer face 22.

In the example described, the edge 27 is relatively wide, with its width being about 5 mm.

On the edge 27, the cover 12 has a hinge lug 30 and a tab 29 designed to be snap-fastened in a housing of the body 11 so as to hold the pack closed when it is not in use.

The front face 20 and the outer face 22 are covered in a layer 33 of a colorless mat varnish.

The rear face 21 in the present embodiment is entirely covered in a layer 34 of opaque black paint.

Surprisingly, the presence of this layer 34 makes it possible to obtain an attractive appearance effect.

Light entering via the outer face 22 as shown in FIG. 4 diffuses through the non-opaque material beneath the front face 20 and creates a halo effect of sufficient contrast because of the presence of the layer 34 of paint.

The front face 20 thus appears to be substantially brighter at its periphery than in its center.

This effect of the light is all the more pronounced on coming closer to the edge 23 of the front face, so as to obtain a particularly pleasing shading-off effect;

Naturally, the invention is not limited to the embodiment described above.

The invention is particularly applicable to any part made out of a non-opaque material, for example the cap of a lipstick case or of a mascara applicator.

What is claimed is:

1. A part of one of a packaging device and a cosmetic accessory, said part comprising:

a portion made of a plastic material or glass that is not opaque, said portion having:

a front face, a rear face, a side face, a layer of an opaque coating of dark color in intimate contact with said rear face at least in a location close to said side face, the location of the coating and the color of said coating being selected in such a manner as to enable light that enters in said portion via the side face to create a light effect with the part and visible from said front face, and a hinge lug projecting from the rear face and integrally molded with the part.

2. A closure member for a cosmetic accessory or receptacle, the member having a top wall and a side skirt extending the periphery of said top wall downwards, said top wall defining a front face of circular outline, said closure member having a side face, the top wall and the side skirt defining a rear face, the top wall and the side skirt being made as a single piece by molding a translucent plastics material, the front face and the side face being covered in a layer of mat varnish, the rear face being covered in a layer of dark-colored opaque paint without discontinuity over at least substantially the entire extent of an edge of the side skirt, over an inside surface of the side skirt, and over at least a portion of an inside surface of the top wall adjacent to the side skirt.

3. A part of one of a packaging device and a cosmetic accessory, said part having:

a front face, a rear face, a side face, wherein the part comprises a plastic material or glass that is not opaque and, at least in locations of the rear face close to said side face, a layer of an opaque paint of dark color in intimate contact with said non opaque material, the location of the paint and its color being selected in such a manner as to enable light that enters via the side face to create a light effect within the part and visible from said front face, and an inner housing opening out into the rear face, wherein said inner housing is defined by a first surface and by a second surface, said first surface extending around said second surface, wherein the first surface is entirely covered without discontinuity by said opaque paint as is at least a margin of said second surface adjacent to said first surface.

4. A part according to claim 3, wherein said first surface is cylindrical or substantially cylindrical.

5. A part of one of packaging device and a cosmetic accessory, said part having:

a front face having a circular outline, a rear face, and a side face, wherein the part comprises a plastic material or glass that is not opaque and, at least in locations of the rear face close to said side face, and a layer of an opaque paint of dark color in intimate contact with said non opaque material, the location of the paint and its color being selected in such a manner as to enable light that enters via the side face to create a halo effect within the part and visible from said front face.

6. A part of one of a packaging device and a cosmetic accessory, said part having:

a front face which is outwardly slightly concave, a rear face, a side face, wherein the part comprises a plastic material or glass that is not opaque and, at least in locations of the rear face close to said side face, and a layer of an opaque paint of dark color in intimate contact with said non-opaque material, the location of the paint and its color being selected in such a manner as to enable light that enters via the side face to create a light effect within the part and visible from said front face.

7. A part of one of a packaging device and a cosmetic accessory, said part having:

a front face, a rear face, a side face, wherein the part comprises a plastic material or glass that is not opaque and, at least in locations of the rear face close to said side face, a layer of an opaque paint of dark color in intimate contact with said non opaque material, the location of the paint and its color being selected in such a manner as to enable light that enters via the side face to create a light effect within the part and visible from said front face, wherein the front face and the side face are covered in a layer of mat varnish.

8. A part of one of a packaging device and a cosmetic accessory, said part having:

a front face, a rear face, a side face at least partially cylindrical wherein the part comprises a plastic material or glass that is not opaque and, at least in locations of the rear face close to said side face, and a layer of an opaque paint of dark color in intimate contact with said non opaque material, the location of the paint and its color being selected in such a manner as to enable light that enters via the side face to create a light effect within the part and visible from said front face.

9. A part of one of a packaging device and a cosmetic accessory, said part having:

a front face, a rear face, a side face, wherein the part comprises a plastic material or glass that is not opaque and, at least in locations of the rear face close to said side face, a layer of an opaque paint of dark color in intimate contact with said non opaque material, the location of the paint and its color being selected in such a manner as to enable light that enters via the side face to create a light effect within the part and visible from said front face, and a hinge lug projecting from the rear face and integrally molded with the part.

10. A part of one of a packaging device and a cosmetic accessory, said part having:

a front face, a rear face, a side face, wherein the part comprises a plastic material or glass that is not opaque and, at least in locations of the rear face close to said side face, and a layer of an opaque paint of dark color in intimate contact with said non opaque material, the location of the paint and its color being selected in such a manner as to enable light that enters via the side face to create a light effect within the part and visible from said front face, wherein the part constitutes all or a portion of a closure member for a make-up accessory.

11. A part of one of a packaging device and a cosmetic accessory, said part having:

a front face, a rear face, a side face, wherein the part comprises a plastic material or glass that is not opaque and, at least in locations of the rear face close to said side face, and a layer of an opaque paint of dark color in intimate contact with said non opaque material, the location of the paint and its color being selected in such a manner as to enable light that enters via the side face to create a light effect within the part and visible from said front face, wherein the part constitutes all or a portion of a closure member for a receptacle.

12. A part having:

a front face, a rear face, and a side face, a plastics material or glass that is not opaque and, at least in locations of the rear face close to said side face, a layer of an opaque paint of dark color in intimate contact with said non-opaque material, the location of the coating and its color being selected in such a manner as to enable light that enters via the side face to create a light effect within the part and visible from said front face, wherein the coating is a layer deposited by bi-injection of a material that is physically and chemically compatible with said non-opaque material, and a hinge lug projecting from the rear face and integrally molded with the part.

13. A part having, a front face having a circular outline, a rear face, a side face, wherein the part comprises a plastics material or glass that is not opaque, and wherein the rear face is made opaque at least in locations close to said side face by a layer of an opaque coating of dark color in intimate contact with said non-opaque material, the location of the coating and its color being selected in such a manner as to enable light that enters via the side face to create a halo effect within the part and visible from said front face, and a hinge lug projecting from the rear face and integrally molded with the part.

14. A part of one of a packaging device and cosmetic accessory, said part having:

an outwardly slightly concave front face, a rear face, a side face, wherein the part comprises a plastic material or glass that is not opaque, and wherein the rear face is made opaque at least in locations close to said side face by means of a layer of an opaque coating of dark color in intimate contact with said non-opaque material, the location of the coating and its color being selected in such a manner as to enable light that enters via the side face to create a light effect within the part and visible from said front face, and a hinge lug projecting from the rear face and integrally molded with the part.

15. A part having:

a front face, a rear face, a side face, wherein the part comprises a non-opaque material made of plastics or glass, wherein the rear face is made opaque at least in locations close to said side face by a layer of an opaque coating of dark color in intimate contact with said non-opaque material, the location of the coating and its color being selected in such a manner as to enable light that enters via the side face to create a light effect within the part and visible from said front face, and a hinge lug projecting from the rear face and integrally molded with the part.

16. A part according to claim 15, wherein the coating is present at locations selected on the part in such a manner that only light entering via the side face or an edge of the rear face can pass through the part.

17. A part according to claim 15, wherein the coating is black in color.

18. A part according to claim 15, wherein the coating is a paint.

19. A part according to claim 15, wherein the coating is a layer deposited by bi-injection of a material that is physically and chemically compatible with the non-opaque material.

20. A part according to claim 15, wherein the non-opaque material is made of a translucent plastics material.

21. A part according to claim 15, wherein the rear face is completely covered in said coating.

22. A part according to claim 15, including an inner housing opening out into said rear face.

23. A part according to claim 22, wherein said inner housing is defined by a first surface and by a second surface, said first surface extending around said second surface, wherein the first surface is entirely covered without discontinuity by said opaque coating as is at least a margin of said second surface adjacent to said first surface.

24. A part according to claim 23, wherein said first surface is cylindrical or substantially cylindrical.

25. A part according to claim 23, wherein said part comprises an edge which extends between the first surface of the inner housing and the side face, said edge being covered without discontinuity over substantially the entire extent of said edge by said opaque coating.

26. A part according to claim 15, wherein the part is configured in such a manner that the halo effect is visible over a peripheral zone of the front face, said peripheral zone being of a width that is no greater than a height of the side face.

27. A part according to claim 15, wherein the front face is outwardly slightly concave.

28. A part according to claim 15, wherein the front face and the side face are covered in a layer of mat varnish.

29. A part according to claim 15, wherein the side face is at least partially cylindrical or conical.

30. A part according to claim 15, wherein the side face, starting from the rear face and going towards the front face, is substantially cylindrical and then conical, diverging forwards.

31. A part according to claim 15, wherein the front face has a circular outline, the light effect obtained being a halo effect.

32. A packaging device comprising a part as defined in claim 15.

33. A packaging device according to claim 32 for packaging a cosmetic product.

34. A cosmetic accessory comprising a part as defined in claim 15.

35. A part of one of a packaging device and a cosmetic accessory, said part comprising:

a portion made of a plastic material or glass that is not opaque, said portion having:

a front face, a rear face, a side face which is at least partially conical, and a layer of an opaque coating of dark color in intimate contact with said rear face at least in a location close to said side face, the location of the coating and the color of said coating being selected in such a manner as to enable light that enters in said portion via the side face to create a light effect within the part and visible from said front face.

36. A part of one of a packaging device and a cosmetic accessory, said part having:

a front face, a rear face, a side face at least partially conical, wherein the par comprises a plastics material or glass that is not opaque and, at least in locations of the rear face close to said side face, and a layer of an opaque paint of dark color in intimate contact with said non opaque material, the location of the paint and its color being selected in such a manner as to enable light that enters via the side face to create a light effect within the part and visible from said front face.

37. A part having:

a front face, a rear face, and a side face at least partially conical, a plastics material or glass that is not opaque and, at least in locations of the rear face close to said side face, and a layer of an opaque coating of dark color in intimate contact with said non opaque material, the location of the coating and its color being selected in such a manner as to enable light that enters via the side face to create a light effect within the part and visible frm said front face, wherein the coating is a layer deposited by bi-injection of a material that is physically and chemically compatible with said non opaque material.

38. A part having, a front face having a circular outline, a rear face, and a side face at least partially conical, wherein the part comprises a plastics material or glass that is not opaque, and wherein the rear face is made opaque at least in locations close to said side face by a layer of an opaque coating of dark color in intimate contact with said non opaque material, the location of the coating and its color being selected in such a manner as to enable light that enters via the side face to create a halo effect within the part and visible from said front face.

39. A part of one of a packaging device and cosmetic accessory, said part having:

an outwardly slightly concave front face, a rear face, and a side face at least partially conical, wherein the part comprises a plastics material or glass that is not opaque, and wherein the rear face is made opaque at least in locations close to said side face by a layer of an opaque coating of dark color in intimate contact with said non opaque material, the location of the coating and its color being selected in such a manner as to enable ligth that enters via the side face to create a light effect within the part and visible from said front face.

* * * * *